US006125487A

United States Patent [19]

Ive

[11] Patent Number: 6,125,487

[45] Date of Patent: Oct. 3, 2000

[54] INFANT SUPPORT CUSHION

[76] Inventor: Ronald A. Ive, 12848 W. Ellsworth Pl., Lakewood, Colo. 80228

[21] Appl. No.: 08/386,670

[22] Filed: Feb. 10, 1995

[51] Int. Cl.[7] ..... A47C 20/02

[52] U.S. Cl. ..... 5/655; 5/603; 5/95

[58] Field of Search ..... 5/655, 603, 632, 5/490, 465, 95

[56] References Cited

U.S. PATENT DOCUMENTS

| | | | |
|---|---|---|---|
| 2,598,999 | 6/1952 | Kelly | 5/95 |
| 3,305,878 | 2/1967 | Hellbaum | 5/465 |
| 3,319,273 | 5/1967 | Solin | 5/465 |
| 3,389,411 | 6/1968 | Emery | 5/490 |
| 3,811,140 | 5/1974 | Burpo | 5/630 |
| 3,871,637 | 3/1975 | Mueller et al. | 269/328 |
| 4,579,111 | 4/1986 | Ledesma | 5/632 |
| 4,606,088 | 8/1986 | Michaelsen et al. | 5/490 |
| 5,161,273 | 11/1992 | Deck | 5/655 |

FOREIGN PATENT DOCUMENTS

| | | | |
|---|---|---|---|
| 1359362 | 3/1964 | France | 5/357 |
| 1449012 | 7/1966 | France | 5/655 |
| 2274246 | 7/1994 | United Kingdom | 5/655 |

OTHER PUBLICATIONS

Changing Pad Sold By Nyvek Corporation.
Changing Pad Produced By Rumble Tough, Located In Utah, U.S.A.

*Primary Examiner*—Anthony Knight
*Assistant Examiner*—Clifford B Vaterlaus
*Attorney, Agent, or Firm*—Timothy J. Martin; Michael R. Henson; Mark H. Weygandt

[57] ABSTRACT

A cushion supports an infant on a support surface, especially as an aid in changing the infant's diapers and garments. The cushion includes an inner elongated pad that is preferably formed as two sections of foam material. The upper surface of the pad is trough-shaped to provide an infant receiving channel, and a casing extends around the pad. Where the pad is in two sections, the casing has a single top panel that supports two pockets that respectively receive a pad section so that they can be pivoted between a folded state and an extended state wherein the pad sections are aligned. This folding occurs about a central transverse line relative to the top panel. When in the extended state, confronting edges of the pockets have fasteners that connect to one another to secure the cushion in the extended state. A restraining strap of elastic or other construction extends transversely across the top of the cushion at a central location, preferably alongside the transverse line. Anchor straps may also be provided to secure the cushion relative to the support surface.

12 Claims, 4 Drawing Sheets

INFANT SUPPORT CUSHION

FIELD OF THE INVENTION

The present invention is related to a cushion to support an infant on a support surface such as a table top, a dresser top, a vehicle cargo bed, etc. More particularly, the present invention concerns a cushion adapted for securing an infant thereon in a laying position and providing a comfortable, sanitary laying surface while the infant's undergarment is being changed.

BACKGROUND OF THE INVENTION

Although needs of an infant are generally limited to warmth, sleep, food and hygiene, caring for an infant is indeed a formidable task. As a result, infant care providers often seek products and methods which make caring for an infant's needs easier for the care provider as well as more beneficial for the infant. Numerous baby products such as baby cribs, baby bottles, food utensils, strollers and the like have made infant care simpler and more enjoyable for the care provider as well as more beneficial for the infant. Specifically in the area of hygiene, disposable diapers have dominated the marketplace over washable, re-usable cloth diapers. However, regardless of the choice between disposable and re-usable diapers by the care provider, problems linger that are associated with changing soiled diapers of infants.

Often, where appropriate, the care provider changes the infant's soiled diaper on a bed, in a crib or on a changing table. When standing while changing the soiled diaper with the infant on the bed or in the crib, the care provider tends to hunch over the infant which can cause back pain. While sitting on the bed while changing the infant's diaper, the care provider has to turn his/her torso sideways to gain a proper vantage position to change the soiled diaper. Such turning can also cause the care provider back pain when changing the infant's diaper while sitting in this turned position. Perhaps a better place to change the soiled diaper is by laying the infant on a more elevated surface such as a top surface of a dresser. This elevated surface allows the care provider to stand directly in front of the infant without having to hunch. In turn, back pain from unusual body positions is alleviated. Unfortunately, the top surface of the dresser is hard and often is quite cold for placing a partially clad or completely nude infant thereon.

A towel or some other sheet material typically fabricated from cloth can help somewhat to add comfort for the infant when being changed on the top surface of the dresser. However, particularly when the infant is feeling frisky, this sheet material begins to slide about the top surface and become disheveled thereby impeding the care provider's efforts in changing the soiled diaper. Of course, when disheveled, the infant is once again exposed to the cold, hard surface of the dresser. Furthermore, other than a careful and watchful care provider, nothing else assists in retaining the infant on the top surface of the dresser. Thus, extreme caution and utmost attention must be taken when changing an infant's diaper on the top surface of the dresser because an active infant can potentially fall off of the dresser.

In lieu of a towel or sheet material, a pillow is sometimes used to provide comfort for the infant and protect the infant from the cold surface. The pillow can also slide around the top surface during changing. Furthermore, it is also possible that the pillow casing can become soiled while changing the infant's diaper. The casing and quite commonly the pillow itself must be laundered to a level of sufficient sanitization before use.

Changing an infant's diaper while travelling can be exceptionally challenging. For example, when traveling on an airplane, the tiny restrooms simply are not conducive for changing the infant's diaper. If the airplane restroom does not provide a fold-out changing table, the infant must be laid on a very small sink counter top in order to be changed. Another example when travelling with an infant is changing the infant in a public restroom. Fortunately, some public restrooms provide the care provider with a fold-down changing table. Unfortunately though, these fold-down changing tables in both airplane restrooms and public restrooms are cold, hard surfaces which have the same inherent disadvantages for changing the infant on top surfaces of dressers.

There is a need to provide a cushion which can be placed on the top support surface of dressers, changing tables, sink counter tops or other support structures so that the infant can lay comfortably on a soft, resilient surface while the infant's diapers can be safely and easily changed. It would be advantageous if such a cushion incorporated structure which would inhibit the infant from rolling off of the cushion and subsequently off of the support surface. There is also a need to provide a cushion that can be secured to the support structure in order to prevent the cushion for sliding about the support surface while changing the infant's diaper. There is also a need to provide a cushion which is suitable portable to render the cushion sufficiently convenient and compact for travelling. It would also be advantageous for such a cushion to be resistant to soiling. The present invention satisfies these needs and provides these advantages.

SUMMARY OF THE INVENTION

It is an object of the present invention to provide a new and useful cushion which can be placed on a support surface of a support structure so that an infant can lay comfortably thereon while a care provider changes the infant's diapers or other clothing articles.

It is another object of the present invention to provide a cushion for an infant in which the infant can be secured therein by adjustable straps.

Another object of the present invention is to provide a cushion for an infant which is designed with a resilient laying surface having a V-shaped cross-section to inhibit the infant from rolling off of the cushion.

Yet another object of the present invention is to provide a cushion which can be placed upon a support surface of a support structure and secured to the support structure to prevent the cushion for sliding thereabout.

Still another object of the present invention is to provide a cushion for an infant which is lightweight and foldable to make it sufficiently compact so that a care provider can travel with the cushion as a convenient and necessary care item for the infant.

Yet another object of the present invention is to provide a cushion for an infant which has a casing which not only protects the pad disposed therein from accidental soiling but also can be easily removed from the pad and sanitized when desired by the care provider.

Accordingly, a cushion of the present invention is hereinafter described. The cushion of the present invention is adapted to support an infant on a support surface of a support structure. In its broadest form, the cushion includes a pad and a casing. The pad has a lower surface, an upper surface and a pair of longitudinally extending side surfaces joining the lower surface and the upper surface. The upper surface is formed in a trough-shaped configuration to define a channel wherein the infant may be supported. The casing is sized and adapted to receive the pad in an interior thereof and includes a bottom panel extending along the lower surface of the pad, a top panel extending along the upper surface of the pad and a pair of side panel portions. Each of the side panel portions extends along a respective side surface of the pad.

Preferably, the pad is fabricated of a resilient foam material, and the casing is formed of a plasticized fabric material so as to prevent the passage of fluids therethrough. The pad is elongated in a longitudinal direction and each of the side surfaces are oriented substantially parallel to one another and perpendicularly to the lower surface with the channel extending in the longitudinal direction.

A restraining strap is connected to the casing and positioned to be extended transversely across the infant supported in the channel, which, in turn, releasably secures the infant therein. The restraining strap is formed by a pair of strap portions with each strap portion having a first end secured relative to the pad and a free second end. The free second ends are provided with cooperating connectors such as cooperative hook and loop so that the free second ends may be releasably secured together with the restraining strap thereby having an effective length operative to secure the infant in the channel. It is preferred that the restraining strap is elastic and includes gathers along its lateral edges. Moreover, it is preferred that the restraining strap has an effective length which is selectively adjustable.

An anchoring structure is preferably secured to the casing and is adapted to be secured to the support structure. The anchoring structure is also operative when in a secured state to inhibit sliding of the pad along the support surface. The anchoring structure includes a plurality of anchor straps with each anchor strap having a first anchor end fastened to the casing and a free second anchor end. Preferably, the anchor structure is a pair of anchor straps. Specifically, each anchor strap has the first anchor end secured to the casing along a first top side edge with the anchor straps being longitudinally spaced apart from one another.

In the preferred embodiment of the present invention the pad is formed as a first pad section having a first upper surface area formed in a trough-shaped configuration, a second pad section having a second upper surface area formed in a trough-shaped configuration and a casing that forms first and second pockets sized and respectively adapted to receive the first and second pad sections in interiors thereof.

Here, the casing has a top panel and first and second bottom panel portions each joined to the top panel by side panel portions. The casing also has a pair of end panels which form the first and second pockets. The top panel is operative to permit flexing about a transverse line so that the first and second pad sections can be moved to and between a folded state and an extended state. In the folded state, the first and second upper surface areas are facing one another in a facing relationship and, in the extended state, the first and second pad sections are longitudinally aligned. The first and second pad sections are oriented such that, when in the extended state, the trough-shaped configurations of the first and second upper surface areas are longitudinally aligned to form a V-shaped channel having divergent sidewalls so that an infant can be supported therein.

Preferably, each of the first and second pad sections is constructed by a pair of foam pieces and formed as a trapezoidal prism. The foam pieces of each of the first and second pad sections have confronting faces which are adhered to one another and opposite faces defining first and second side surfaces. Also, the foam pieces have angled faces which define the trough-shaped configurations of the pad sections, such that the sidewalls of the resulting channel are oriented relative to each other at an obtuse angle of between 120° and 150°, inclusively.

With this construction, the first and second bottom panel portions have contiguous central edges when the first and second pad sections are in the extended state. It is preferred that these contiguous central edges include matable fasteners which are releasably connectable to one another. Thus, when the contiguous central edges become fastened to one another, the first and second pad sections are secured in the extended state. This alternative embodiment also includes a restraining strap and an anchoring structure.

These and other objects of the present invention will become more readily appreciated and understood from consideration of the following detailed description of the exemplary embodiments of the present invention when taken in conjunction with the accompanying drawings, in which:

DETAILED DESCRIPTION OF THE EXEMPLARY EMBODIMENTS

A cushion of the present invention is adapted to support an infant on a support surface of a support structure. One of ordinary skill in the art would appreciate that there are numerous types of support surfaces and support structures. By way of example only, a top surface of a dresser is employed for the description of the exemplary embodiments. Furthermore, although the cushion of the present invention is described for the specific use of changing an infant's diaper, the present invention might be used for other infant care functions.

Figure 1:
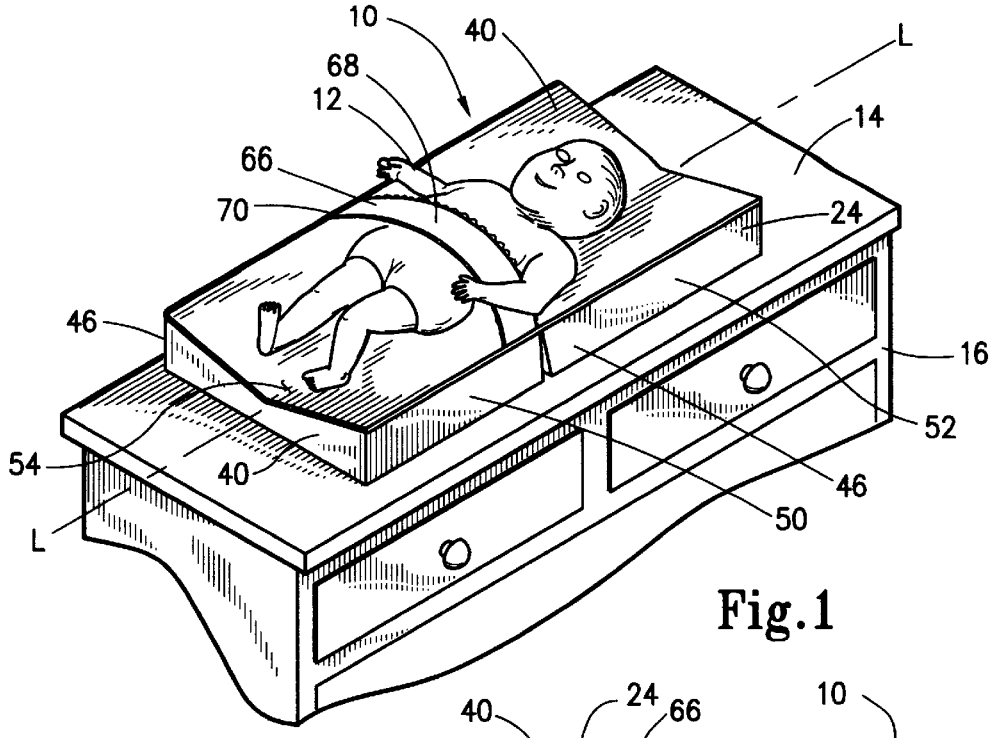
FIG. 1 is a front perspective view of a first exemplary embodiment of a cushion of the present invention placed upon a support surface of a support structure in a form of a dresser whereupon an infant is being supported by the cushion of the present invention.
Figure 2:
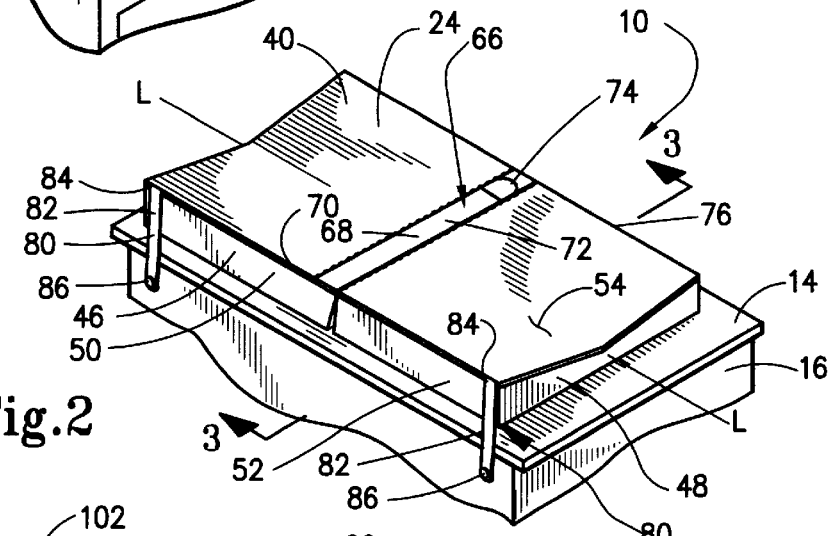
FIG. 2 is a rear perspective view of the cushion of the FIG. 1 (without the infant) showing a restraining strap and an anchoring structure extending from the cushion for securing the cushion to the support structure.
Figure 3:
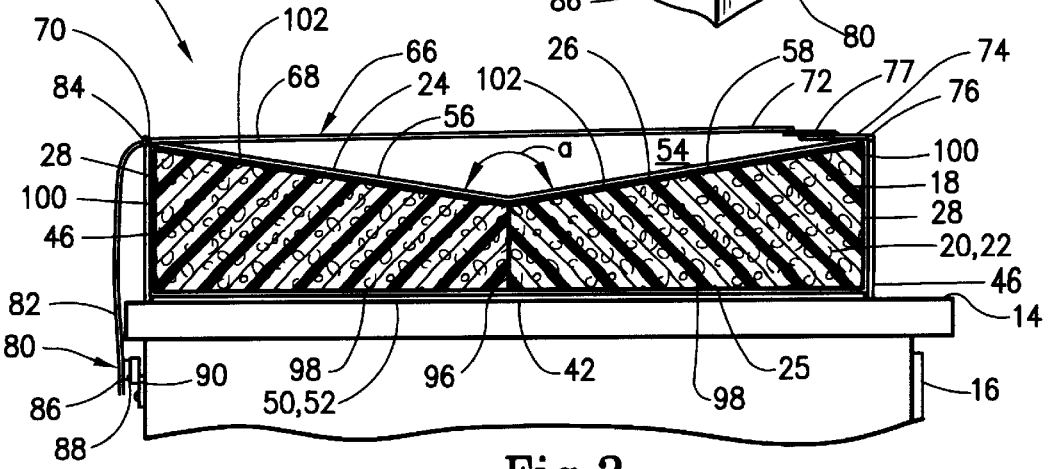
FIG. 3 is an end view in cross-section of the cushion taken along line 3—3 of FIG. 2.

A first exemplary embodiment of a cushion 10 of the present invention is generally introduced in FIGS. 1–11. Cushion 10 is adapted to support an infant 12 on a support surface 14 of a support structure 16 such as a top surface of a conventional dresser shown in FIGS. 1 and 2. Cushion 10 includes a pad 18 in a form of a first pad section 20 and a second pad section 22 and a casing 24. As best shown in FIG. 3, first pad section 20 is formed of a resilient foam material and having a first lower surface area 25, a first upper surface area 26 and a pair of longitudinally extending first side surface areas 28 joining first lower surface area 25 and upper surface area 26. First upper surface area 26 is formed in a trough-shaped configuration. Preferably, second pad section 22 is identical to first pad section 20. Specifically with reference to FIGS. 6 and 8, it may be seen that second pad section 22 is also formed of a resilient foam material and has a second lower surface area 30, a second upper surface area 32 and a pair of longitudinally extending second side surface areas such as second side surface area 34 joining second lower surface area 30 and upper surface area 32.

Figure 6:
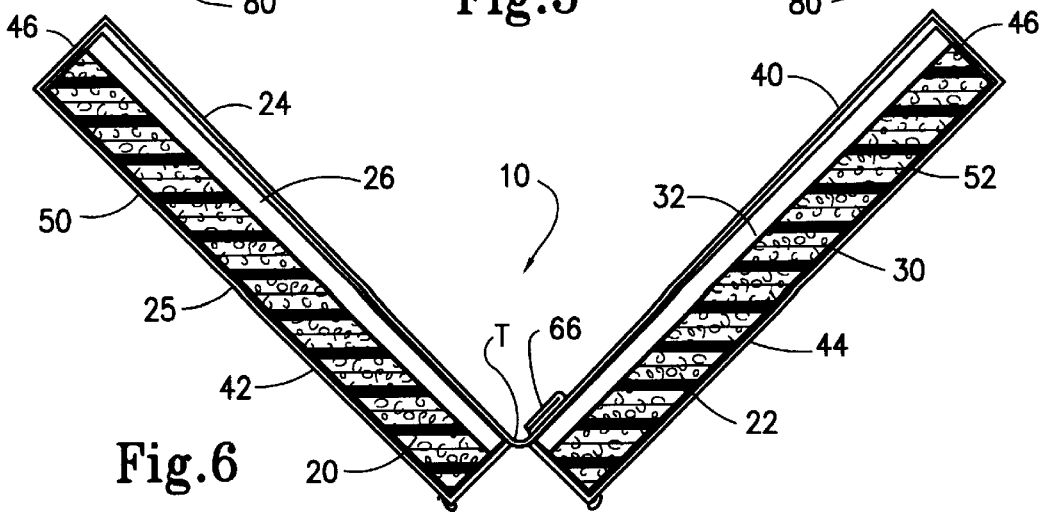
FIG. 6 is a side view in cross-section of the cushion shown in FIGS. 1–5 depicted in a partially folded state with the cross-section extending centrally and longitudinally along the cushion.

As is shown in FIG. 6, second upper surface area 32 is also formed in a trough-shaped configuration. Pad 18, which is formed by first pad section 20 and second pad section 22, is elongated in a longitudinal direction shown by longitudinal axis "L" when in the extended state. The pair of first side surface areas 28 are oriented substantially parallel to one another and perpendicularly to first lower surface area 25 and the pair of second side surface areas 34 are oriented substantially parallel to one another and perpendicularly to second lower surface 30. When in the extended state, lower surface areas 25, 30 are coplanar to define a common lower surface for pad 18, and upper surface areas 26, 32 are aligned to form a common upper surface for pad 18. Likewise a first pair of side surface areas 28, 34 form one common side surface for pad 18 while another pair of side surface areas 28, 34 form the other side surface for pad 18.

Casing 24 is formed of a flexible material. It is preferred that the flexible material is a plasticized fabric material such as one shown in FIG. 8. This material has an outer terry cloth surface to which an inner waterproofing layer of plastic material is integrally bonded. The plasticized material includes an outer water absorbent material 38 such as cotton and cotton blend fabric and an inner water-proof or water-repellant material 36 such as plastic. Casing 24 has a top panel 40 and a first and a second bottom panel portion 42 and 44 respectively joined to top panel 40 by a pair of side panel portions 46 and a pair of end panels 48. Thus, casing 24 forms a first and a second pocket 50 and 52 respectively. Each of first and second pockets 50 and 52 is sized and adapted to a receive respective one of the first and second pad sections 20 and 22 in interiors thereof.

Figure 4:
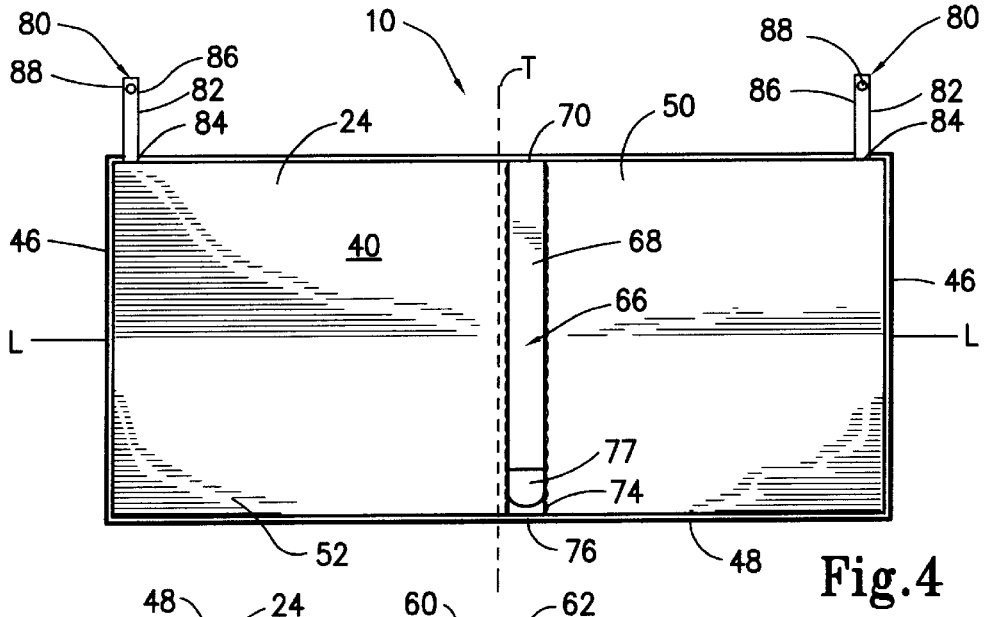
FIG. 4 is a top plan view of the cushion of the present invention shown in FIGS. 1 and 2 and in an extended state.
Figure 7:
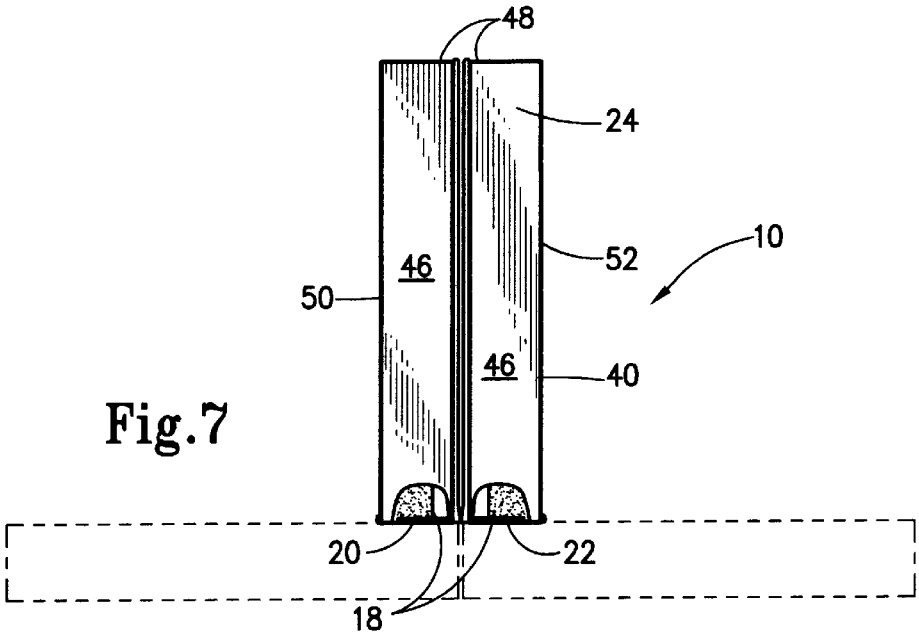
FIG. 7 is a side view in elevation of the cushion of FIGS. 1–6 shown in a folded state whereby upper surface areas of the first and second pad sections are in a facing relationship and also shown in phantom in the extended state whereby the first and second pad sections are longitudinally aligned.
Figure 10:
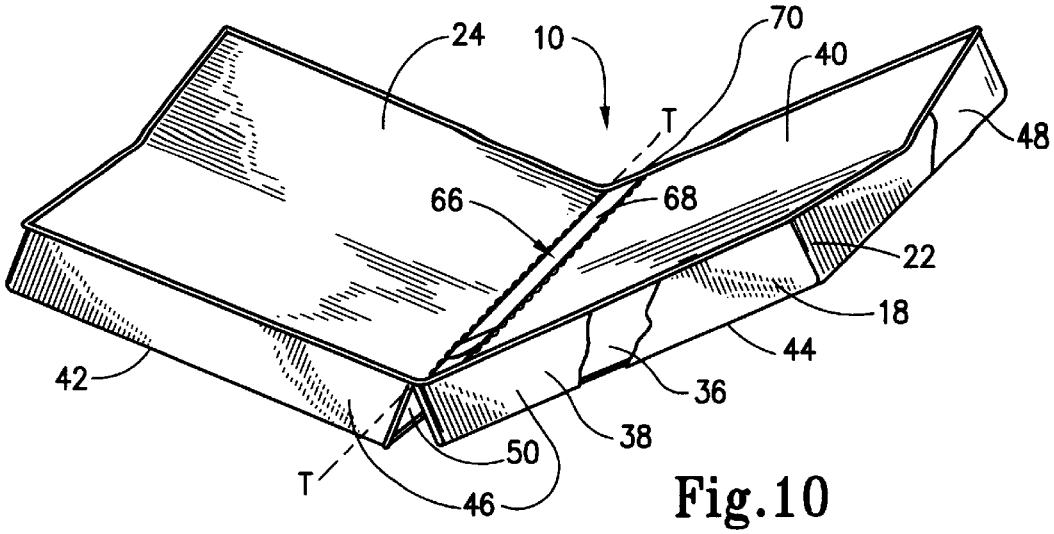
FIG. 10 is a perspective view of the cushion of the present invention partially broken away to show one of the first and second pad sections and being partially folded between the folded state and the extended state.

Top panel 40 is operative to permit flexing about a transverse line "T" shown in FIGS. 4 and 10 whereby first and second pad sections 20 and 22 respectively can be moved between a folded state and an extended state as best shown in FIG. 7. In the folded state, first and second upper surface areas 26 and 32 of respective ones of first and second pad sections 20 and 22 are facing one another. In the extended state, first and second pad sections 20 and 22 are longitudinally aligned as shown in FIGS. 1–5. When first and second pad sections 20 and 22 are oriented in the extended state, the trough-shaped configurations of first and second pad sections 20 and 22 are longitudinally aligned to form a channel 54 which has divergent sidewalls 56 and 58 so that infant 12 can be supported therein as best shown in FIG. 3. It is preferred that channel 54 is V-shaped in cross-section and that divergent sidewalls 56 and 58 are disposed relative to each other at an obtuse angle "a" of between 120° and 150°, inclusively. Naturally, other suitably shaped cross-sections for channel 54 could be employed without departing from the scope of this invention.

Figure 5:
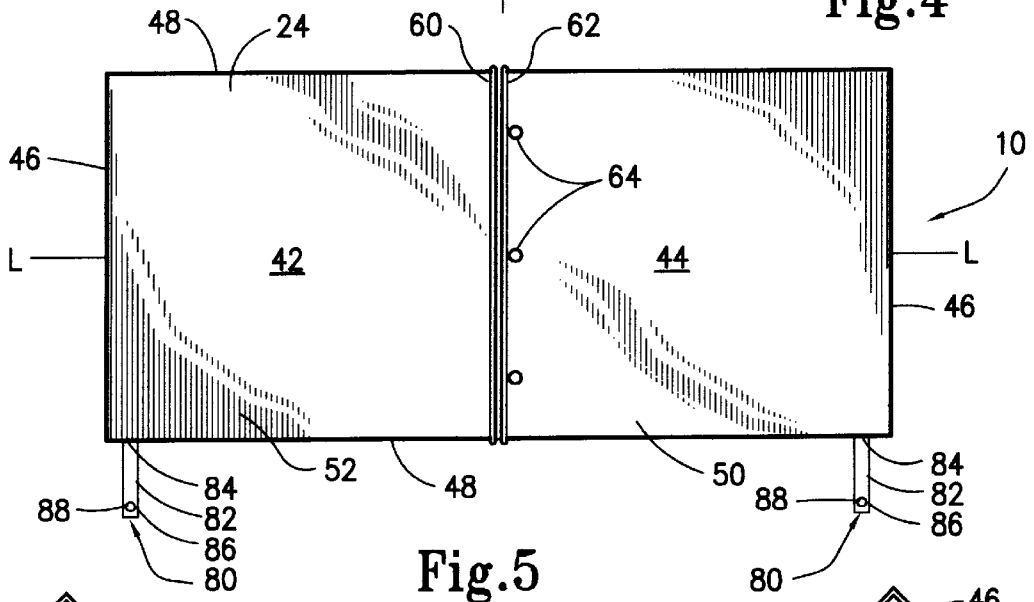
FIG. 5 is a bottom plan view of the cushion of the present invention shown in FIGS. 1 and 2 and in an extended state.
Figure 8:
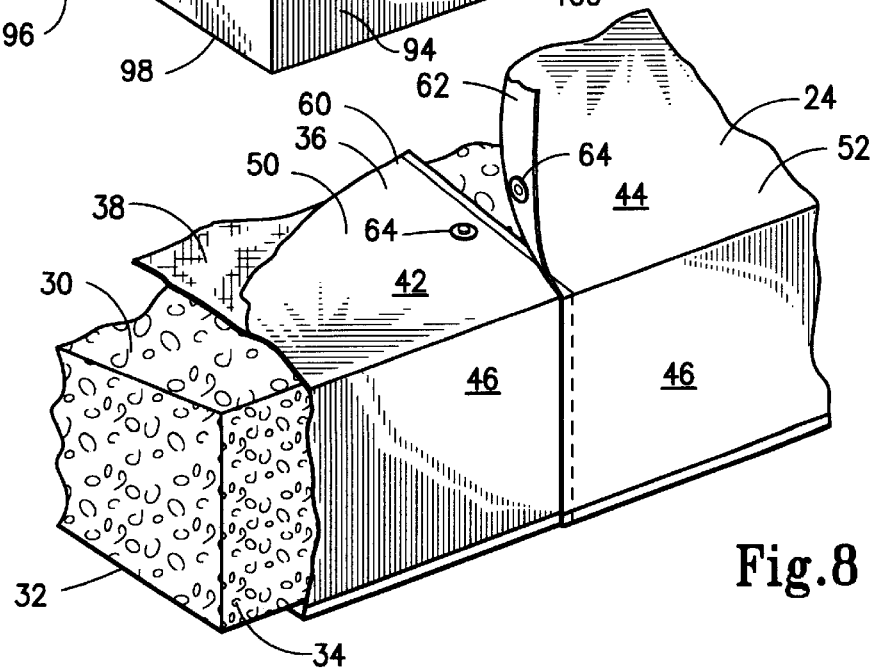
FIG. 8 is an enlarged perspective view of a section of the cushion of the present invention.

With reference to FIGS. 5 and 8, first and second bottom panel portions 42 and 44 have contiguous central edges 60 and 62 respectively when first and second pad sections 20 and 22 are in the extended state. First and second bottom panel portions 42 and 44 also include matable fasteners 64 such as metal snaps which are affixed on contiguous central edges 60 and 62. Matable fasteners 64 are releasably connectable to one another so that contiguous central edges 60 and 62 become fastened to each other thereby securing first and second pad sections 20 and 22 in the extended state.

Cushion 10 of the present invention includes a restraining strap 66 which is connected to casing 24 and positioned to be extended transversely across infant 12 supported in channel 54 thereby releasably securing infant 12 therein. Restraining strap 66 has a first strap end 68 secured to casing 24 at a first top side edge 70 located at a junction of top panel 40 and one of side panel portions 46 and a free second strap end 72. Restraining strap 66 also includes a first connector 74 secured to casing 24 at a second top side edge 76 located at a junction of top panel 40 and an opposed one of the side panel portions 46. Free second strap end 72 includes a second connector 77 of a type securable to first connector 74 such that restraining strap 66 extends transversely of top panel 40 alongside transverse fold line "T". For the first exemplary embodiment of cushion 10 of the present invention, first and second connectors 74 and 76 are cooperative hook and loop fasteners which have a short pile. Having a short pile reduces the chances of the infant from being scratched or chaffed.

Figure 11:
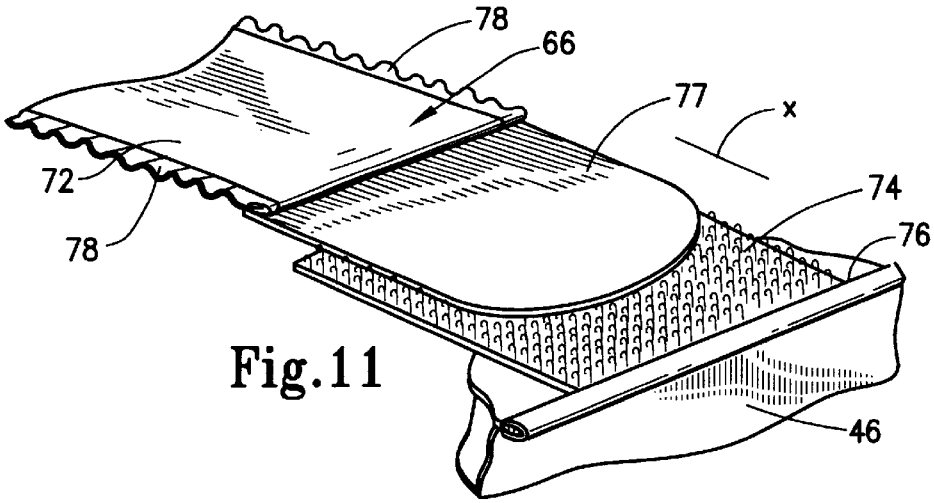
FIG. 11 is an enlarged perspective view of a free end of a first strap end with a hook and loop fastener and second strap end secured to the casing with a matable hook and loop fastener secured together.

Restraining strap 66 is formed of a flexible elastic material and, as a result, has an effective length which is selectively adjustable. For example, in FIG. 11, second connector 77 can be moved in a direction of arrow "x" as long as second connector 77 can cooperate with first connector 74 by either stretching or relaxing restraining strap 66. Further, to reduce chafing against or pinching of an infant's skin restraining strap 66 has lateral edges provided with gathers 78 as shown in FIG. 11.

Cushion 10 also includes an anchoring structure 80 which is secured to casing 24 and adapted to be secured to said support structure 16. Anchoring structure 80 is operative when in a secured state as best shown in FIGS. 2 and 3 to inhibit sliding of cushion 10 along support surface 14. Anchoring structure 80 includes a plurality of anchor straps 82 which are longitudinally spaced apart from one another. Although not by way of limitation, first exemplary embodiment of cushion 10 of the present invention has a pair of anchor straps 82. Each of anchor straps has a first anchor end 84 fastened to casing 24 and a free second end 86 disposed opposite of first anchor end 84. Specifically, first anchor end 84 is secured to casing 24 along first top side edge 70. Each of free second ends 86 has a first anchor fastener 88 connected thereto and support structure 16 has a second anchor fastener 90, mounted on the support structure, which cooperates with first anchor fastener 88 that is connected thereto as best shown in FIG. 3. One of ordinary skill in the art would appreciate that releasably fastening the first and second anchor fasteners 88 and 90 together results in securing cushion 10 to support structure 16 in a manner to inhibit cushion 10 from sliding about support surface 14. Moreover, it should be understood that any suitable type of fastener could be employed.

Figure 9:
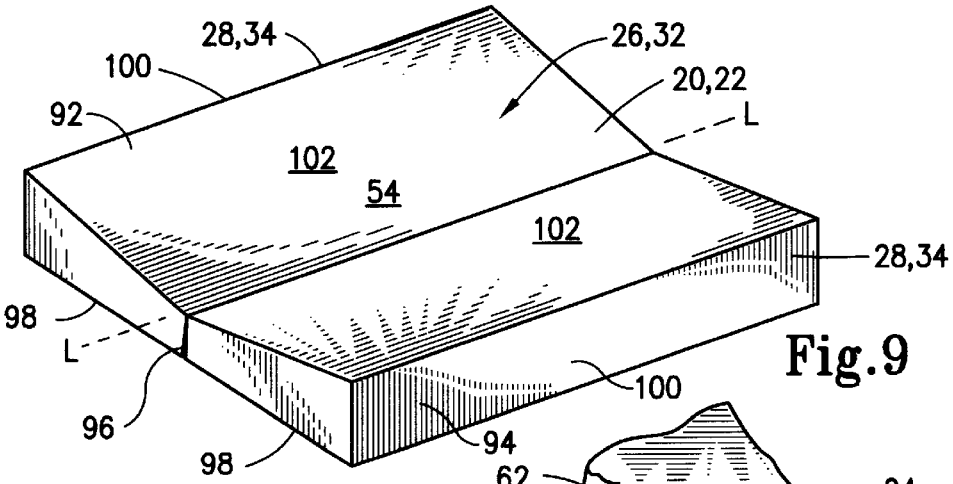
FIG. 9 is a perspective view of a representative second pad section used to construct the pad of the cushion shown in FIGS. 1–8.

With reference to FIGS. 3 and 9, each of first and second pad sections 20 and 22 is constructed by a pair of foam pieces 92 and 94. Each foam piece 92 and 94 is formed as a trapezoidal prism. Foam pieces 92 and 94 of each of said first and second pad sections 20 and 22 have confronting faces 96 adhered to one another and have coplanar faces 98 thereof defining the first and second lower surfaces 25 and 30, respectively. Foam pieces 92 and 94 of each of said first and second pad sections 20 and 22 have opposite faces 100 which define first and second side surfaces 28 and 34, respectively. Foam pieces 92 and 94 of each of said first and second pad sections 20 and 22 also have angled faces 102 which define the upper surface areas 26 and 32, respectively of first and second pad sections 20 and 22.

Figure 12:
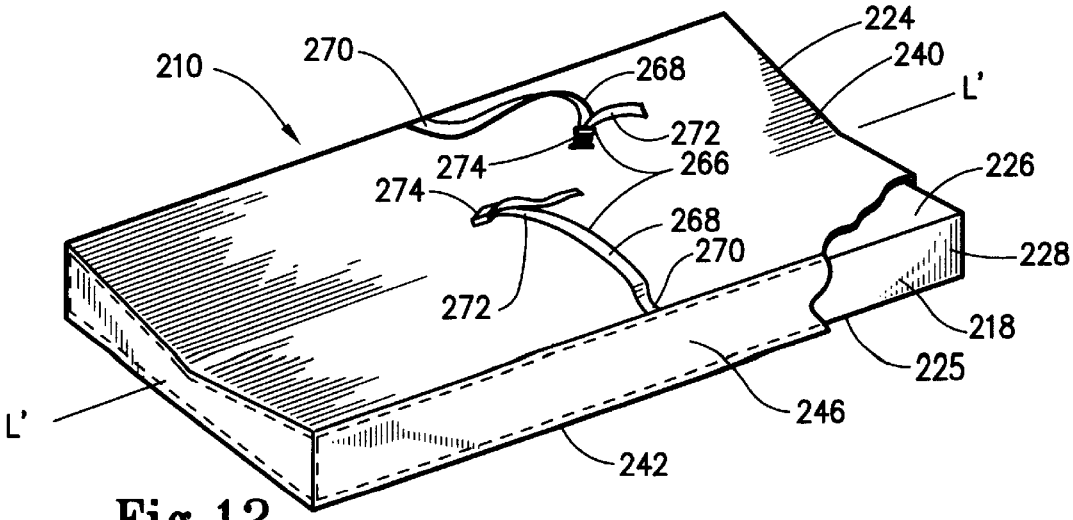
FIG. 12 is a perspective view of a second exemplary embodiment of a cushion of the present invention with a restraining strap with alternative mating connectors.

A second exemplary embodiment of a cushion 210 of the present invention is illustrated in FIG. 12. Cushion 210 includes a pad 218 and a casing 224. Here, cushion 210 is not foldable so that a single elongated pad 218 is received in a casing 224. Pad 218 has a lower surface 225, and upper surface 226 and a pair of longitudinally extending side surfaces 228 joining the lower and upper surfaces. The upper surface 226 is also formed in the trough-shaped configuration to define a V-shaped channel whereby the infant may be supported therein. The V-shaped channel also extends in the longitudinal direction.

Likewise casing 224 is similar as casing 24 described hereinabove but is designed to receive and retain just one pad 218 as opposed to the first and second pad sections 20 and 22. Casing 224 is sized and adapted to receive pad 218 in the interior thereof. Casing 224 includes a bottom panel 242 extending along the lower surface 225 of pad 218. A top panel 240 extends along the upper surface 226 of pad 218, and a pair of side panels, such as side panel 246, extends along a respective one of the side surfaces 228 of pad 218.

The second exemplary embodiment of cushion 210 also includes a restraining strap 266. Unlike the first exemplary embodiment of the present invention, restraining strap 266 is formed by a pair of strap portions 268. Each strap portion 268 has a first end 270 secured relative to pad 218 and a free second end 272. Second ends 272 are provided with cooperating connectors 274 so that second ends 272 may be releasably secured together with restraining strap 266 thereby having an effective length operative to secure the infant in the channel.

As a result of the present invention, a cushion can be placed on a support surface of a support structure so that an infant can lay comfortably thereon. Further, the infant can be secured therein by adjustable straps. Also, the resilient laying surface has a V-shaped cross-section that collapses under the weight of the baby which inhibits the infant from rolling off of the cushion. As an added safety feature for the infant, the cushion can be secured to the support structure to prevent the cushion for sliding thereabout. The cushion is lightweight and foldable. Therefore, the cushion in the folded state is sufficiently compact so that a care provider can travel with the cushion as a convenient and necessary care item for the infant. Additionally, the casing fabricated from a plasticized material protects the pad disposed in the pocket of the casing from accidental soiling. If soiled or when otherwise desired, the casing can be easily removed from the pad and sanitized by the care provider.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A cushion adapted to support an infant on a support surface of a support structure, comprising:

(a) a pad having a lower surface, an upper surface and a pair of longitudinally extending side surfaces joining the lower surface and the upper surface, the upper surface being formed in a trough-shaped configuration to define a channel whereby the infant may be supported therein, said pad being formed by first and second pad sections each having respective trough-shaped upper surface areas;

(b) a casing sized and adapted to receive said pad in an interior thereof, said casing including a bottom panel extending along the lower surface of said pad, a top panel extending along the upper surface of said pad and a pair of side panels each extending along a respective side surface of said pad, said bottom panel and said side panels being separated into bottom panel portions and side panel portions respectively associated with said first and second pad sections whereby said casing has first and second pockets adapted to receive said first and second pad sections, respectively, said cushion thereby being foldable between an extended state wherein said first and second pad sections are longitudinally aligned with said upper surface areas thereby defining the upper surface of said pad and a folded state wherein the upper surface areas of said first and second pad sections are in a facing relationship; and (c) a restraining strap connected to said casing and positioned to be extended transversely across the channel thereby to releasably secure the infant therein.

2. A cushion according to claim 1 including fasteners operative to selectively secure said cushion in the extended state.

3. A cushion adapted to support an infant on a support surface of a support structure, comprising:

(a) a first pad section formed of a resilient foam material and having a first lower surface area, a first upper surface area and a pair of longitudinally extending first side surface areas joining the first lower surface area and the upper surface area, the first upper surface area being formed in a trough-shaped configuration;

(b) a second pad section formed of a resilient foam material and having a second lower surface area, a second upper surface area and a pair of longitudinally extending second side surface areas joining the second lower surface area and the second upper surface area, the second upper surface area being formed in a trough-shaped configuration; and (c) a casing formed of a flexible material and having a top panel and first and second bottom panel portions each joined to said top panel by a pair of side panel portions, said casing having a pair of end panels such that said casing has first and second pockets with interiors respectively sized and adapted to receive said first and second pad sections, said top panel operative to permit flexing about a transverse line whereby said first and second pad sections can be moved between a folded state wherein the first and second upper surface areas are facing one another to an extended state wherein said first and second pad sections are longitudinally aligned, said first and second pad sections being oriented such that, when in the extended state, the trough-shaped first and second upper surface areas are longitudinally aligned to form an upper surface defining a channel having divergent sidewalls whereby an infant can be supported therein.

4. A cushion according to claim 3 wherein said channel is V-shaped in cross-section.

5. A cushion according to claim 3 wherein said sidewalls are disposed relative to each other at an obtuse angle of between 120° and 150°, inclusively.

6. A cushion according to claim 3 wherein said first and second bottom panel portions have contiguous central edges when said first and second pad sections are in the extended state, and including matable fasteners on said contiguous central edges, said matable fasteners releasably connectable to one another whereby said contiguous central edges become fastened thereby securing said first and second pad sections in the extended state.

7. A cushion according to claim 3 including a restraining strap having a first strap end secured to said casing at a first top side edge located at a junction of said top panel and a first pair of said side panel portions and having a free second strap end, and including a first connector secured to said casing at a second top side edge located at a junction of said top panel and a second pair of said side panel portions, said second strap end including a second connector of a type securable to said first connector such that said restraining strap extends transversely of said top panel alongside the transverse line.

8. A cushion according to claim 7 wherein said restraining strap is formed of a flexible elastic material.

9. A cushion according to claim 8 wherein lateral edges of said restraining strap are provided with gathers.

10. A cushion according to claim 7 wherein said first and second connectors are cooperative hook and loop fasteners.

11. A cushion according to claim 7 including a pair of anchor straps each having a first anchor end secured to said casing along the first top side edge, said anchor straps being longitudinally spaced apart from one another.

12. A cushion according to claim 3 wherein each of said first and second pad sections is constructed by a pair of foam pieces each formed as a trapezoidal prism with said foam pieces of each of said first and second pad sections having confronting faces adhered to one another with coplanar faces thereof defining the first and second lower surface areas, respectively, and with opposite faces defining said first and second side surface areas, respectively, and with angled faces defining said first and second upper surface areas, respectively.

* * * * *